US009302235B2

(12) United States Patent
Fu et al.

(10) Patent No.: US 9,302,235 B2
(45) Date of Patent: Apr. 5, 2016

(54) MICROFLUIDIC MIXING DEVICE

(71) Applicant: NATIONAL PINGTUNG UNIVERSITY OF SCIENCE & TECHNOLOGY, Pingtung County (TW)

(72) Inventors: Lung-Ming Fu, Pingtung County (TW); Wei-Jhong Ju, Pingtung County (TW)

(73) Assignee: National Pingtung University of Science & Technology, Pingtung County (TW)

( * ) Notice: Subject to any disclaimer, the term of this patent is extended or adjusted under 35 U.S.C. 154(b) by 0 days.

(21) Appl. No.: 14/487,206

(22) Filed: Sep. 16, 2014

(65) Prior Publication Data

US 2015/0209743 A1 Jul. 30, 2015

(30) Foreign Application Priority Data

Jan. 29, 2014 (TW) ..... 103103355 A

(51) Int. Cl.

| | |
|---|---|
| ***B01F 13/00*** | (2006.01) |
| ***B01F 15/00*** | (2006.01) |
| ***B01F 11/00*** | (2006.01) |
| *B01F 15/06* | (2006.01) |

(52) U.S. Cl.

CPC ..... *B01F 13/0059* (2013.01); *B01F 11/0071* (2013.01); *B01F 15/00175* (2013.01); *B01F 15/065* (2013.01); *B01F 2015/062* (2013.01)

(58) Field of Classification Search

USPC ..... 366/101, 145

See application file for complete search history.

(56) References Cited

U.S. PATENT DOCUMENTS

| | | | | |
|---|---|---|---|---|
| 7,465,545 | B2 * | 12/2008 | Kim et al. | 435/287.2 |
| 7,591,302 | B1 * | 9/2009 | Lenehan et al. | 165/247 |
| 2004/0099712 | A1 * | 5/2004 | Tonkovich et al. | 228/193 |
| 2009/0269250 | A1 * | 10/2009 | Panagiotou et al. | 422/129 |
| 2010/0032141 | A1 * | 2/2010 | Heydari et al. | 165/104.33 |
| 2011/0024079 | A1 * | 2/2011 | Yuan | 165/61 |
| 2011/0146956 | A1 * | 6/2011 | Stroock et al. | 165/104.26 |
| 2011/0250690 | A1 * | 10/2011 | Craig | 435/404 |
| 2012/0067723 | A1 * | 3/2012 | Rearick et al. | 204/408 |

* cited by examiner

*Primary Examiner* — David Sorkin
*Assistant Examiner* — Abbas Rashid
(74) *Attorney, Agent, or Firm* — Alan D. Kamrath; Kamrath IP Lawfirm, P.A.

(57) ABSTRACT

A microfluidic mixing device includes a body having a base, a sealing cover, and a thermally conductive member. The base includes a compartment. A chip access opening is defined in an end of the compartment. An engagement opening is defined in the other end of the compartment. The base further includes a gas port intercommunicated with the compartment. The sealing cover is detachably mounted to the base to seal the chip access opening. The thermally conductive member is mounted to the base and seals the engagement opening. A gas passage is defined between the thermally conductive member and an inner periphery of the base, is located in the compartment, and intercommunicates with the gas port. A pressure control module is connected to the gas port of the base. A heating module is coupled to the thermally conductive member. A cooling module is coupled to the thermally conductive member.

16 Claims, 5 Drawing Sheets

MICROFLUIDIC MIXING DEVICE

BACKGROUND OF THE INVENTION

1. Field of the Invention

The present invention relates to a microfluidic mixing device and, more particularly, to a microfluidic mixing device that can be used with a microfluidic chip.

2. Description of the Related Art

Due to development of micro electromechanical techniques, people in the art use micro electromechanical procedures to reduce and integrate large analyzing instruments into a microchip (which is referred to as "lab-on-a-chip"). The product is a biochip or biomedical chip having advantages including reducing the consumption of the biological reagents, saving energy, reducing costs, reducing reaction time, and increasing detection precision. In recent years, microfluidic systems have been actively applied in the biomedical and chemical fields and, thus, produce microfluidic chips for use in mixing several liquids and conducting characteristic detection.

However, in use of the above microfluidic chips, a trace syringe pump is generally used as the device for injecting and pressurizing the liquids to be mixed. Before proceeding with microfluidic mixing, a needle of the trace syringe pump is bonded to an injection port of a microfluidic chip, leading to operational inconvenience and risks of injury to the operator by the needle. Furthermore, the preprocess is time-consuming and, thus, adversely affects the liquid mixing efficiency and the subsequent detection efficiency. Furthermore, in a case that the number of sets of liquids to be mixed is large, a plurality of trace syringe pumps is required. However, the costs of trace syringe pumps are high, which causes problems to the detecting unit in obtaining a balance among the hardware costs, mixing, and detection efficiency.

Furthermore, during detection of the microfluids, if it is desired to heat or cool the test solution after mixing, an additional heating or cooling device is required. After the trace syringe pump has injected the liquids into the microfluidic chip and mixed the liquids, the microfluidic chip is moved into the heating or cooling device to proceed with heating or cooling. Thus, the liquid mixture could be affected by the environmental change while moving the microfluidic chip, and the detection result could be affected. Furthermore, the devices used in the detecting procedure are independent from each other, which not only occupy a larger space but are inconvenient to portability.

SUMMARY OF THE INVENTION

An objective of the present invention is to solve the above drawbacks by providing a microfluidic mixing device that utilizes a single pressure control module to control simultaneous mixing of a plurality of sets of liquids, reducing the hardware cost and increasing the detection efficiency.

Another objective of the present invention is to provide a microfluidic mixing device to accomplish all operations required for mixing the microfluids at a time, increasing the precision of the detection result.

A further objective of the present invention is to provide a microfluidic mixing device with portability.

The present invention fulfills the above objectives by providing a microfluidic mixing device including a body having a base, a sealing cover, and a thermally conductive member. The base is hollow and includes a compartment. A chip access opening is defined in an end of the compartment. An engagement opening is defined in the other end of the compartment.

The base further includes a gas port intercommunicated with the compartment. The sealing cover is detachably mounted to the base to seal the chip access opening. The thermally conductive member is mounted to the base and seals the engagement opening. A gas passage is defined between the thermally conductive member and an inner periphery of the base and is located in the compartment. The gas passage intercommunicates with the gas port. A pressure control module is connected to the gas port of the base. A heating module is coupled to the thermally conductive member. A cooling module is coupled to the thermally conductive member.

The thermally conductive member can include an insertion portion and a sealing portion. The sealing portion is coupled to an end of the insertion portion. The insertion portion extends through the engagement opening of the base and is received in the compartment. The sealing portion abuts a bottom face of the base to seal the engagement opening of the base.

The insertion portion of the thermally conductive member can include an outer periphery having a face extending in an axial direction. The face does not abut the inner periphery of the base to form the gas passage.

In an example, the insertion portion has a maximal outer diameter equal to a minimal diameter of the inner periphery of the base, and the insertion portion of the thermally conductive member tightly engages with the inner periphery of the base.

In another example, the insertion portion has a maximal outer diameter smaller than a minimal diameter of the inner periphery of the base, and an adhesive is applied to an outer periphery of the insertion portion of the thermally conductive member to tightly bond with the inner periphery of the base.

The pressure control module can include a piping unit, a gas pressure source, and first and second electromagnetic valves. The piping unit forms a pressurizing passage and a pressure relief passage. An end of the pressurizing passage and an end of the pressure relief passage intercommunicate with the gas port of the base. The other end of the pressurizing passage intercommunicates with the gas pressure source. The first electromagnetic valve is mounted on the pressurizing passage, and the second electromagnetic valve is mounted on the pressure relief passage.

The piping unit can include a first pipe, a second pipe, and a third pipe. An end of the first pipe, an end of the second pipe, and an end of the third pipe intercommunicate with each other. The other end of the first pipe is connected to the gas port of the base. The other end of the second pipe is connected to the gas pressure source. The first electromagnetic valve is mounted on the second pipe. The second electromagnetic valve is mounted on the third pipe. The first pipe and the second pipe form the pressurizing passage. The first pipe and the third pipe form the pressure relief passage.

The pressure control module can further include a pressure adjusting valve mounted to the gas pressure source. The pressure adjusting valve is adapted to control an input amount of a gas from the gas pressure source.

The heating module can include a heating member extending through and coupled to the sealing portion of the thermally conductive member.

The heating module can further include a temperature sensor and a temperature controller. The temperature sensor extends through the base and is coupled to the thermally conductive member. The temperature controller is electrically connected to the heating member and the temperature sensor.

The temperature sensor can extend through the base and can be coupled to the insertion portion of the thermally conductive member.

The thermally conductive member can include a chip compartment having an opening facing the chip access opening of the base.

The chip access opening and the engagement opening of the compartment can be respectively located on two axially opposite ends of the compartment.

The base can further include a protrusion in a location corresponding to the chip access opening, and the sealing cover is detachably mounted to the protrusion.

The cooling module can include a cooling chip and a cooler. The cooling chip includes a cold end abutting the sealing portion of the thermally conductive member. The cooling chip further includes a hot end coupled to the cooler.

The cooling module can further include a cooling fan coupled to the cooler.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

DETAILED DESCRIPTION OF THE INVENTION

Figure 1:
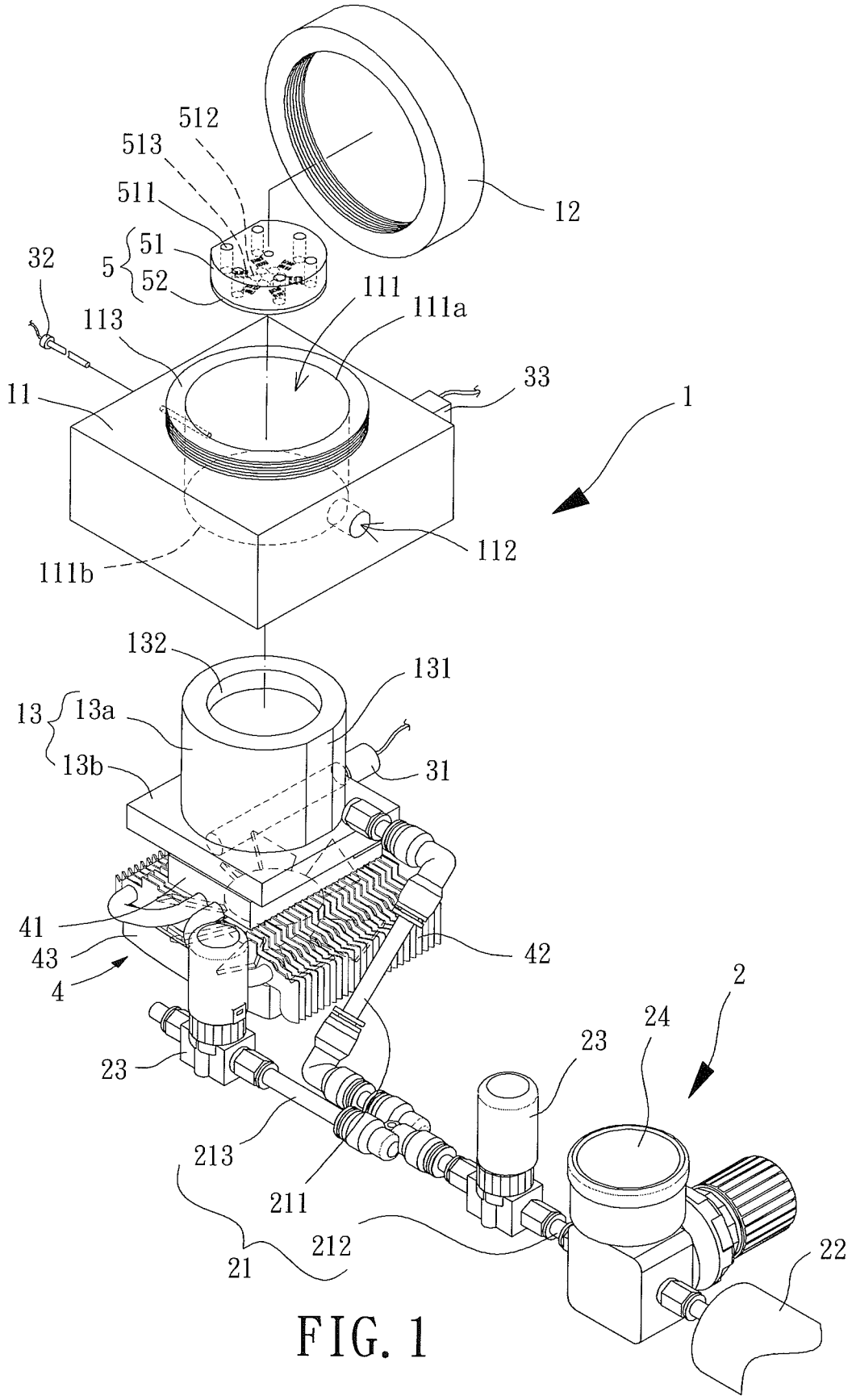
FIG. 1 is an exploded, perspective view of a microfluidic mixing device of an embodiment according to the present invention.

FIG. 1 shows a microfluidic mixing device of an embodiment according to the present invention. The microfluidic mixing device generally includes a body 1, a pressure control module 2, a heating module 3, and a cooling module 4. The body 1 can receive at least one microfluidic chip 5. The pressure control module 2, the heating module 3, and the cooling module 4 are coupled to the body 1. The pressure control module 2 controls the environmental pressure of the microfluidic chip 5. The heating module 3 and the cooling module 4 control the environmental temperature of the microfluidic chip 5.

Figure 2:
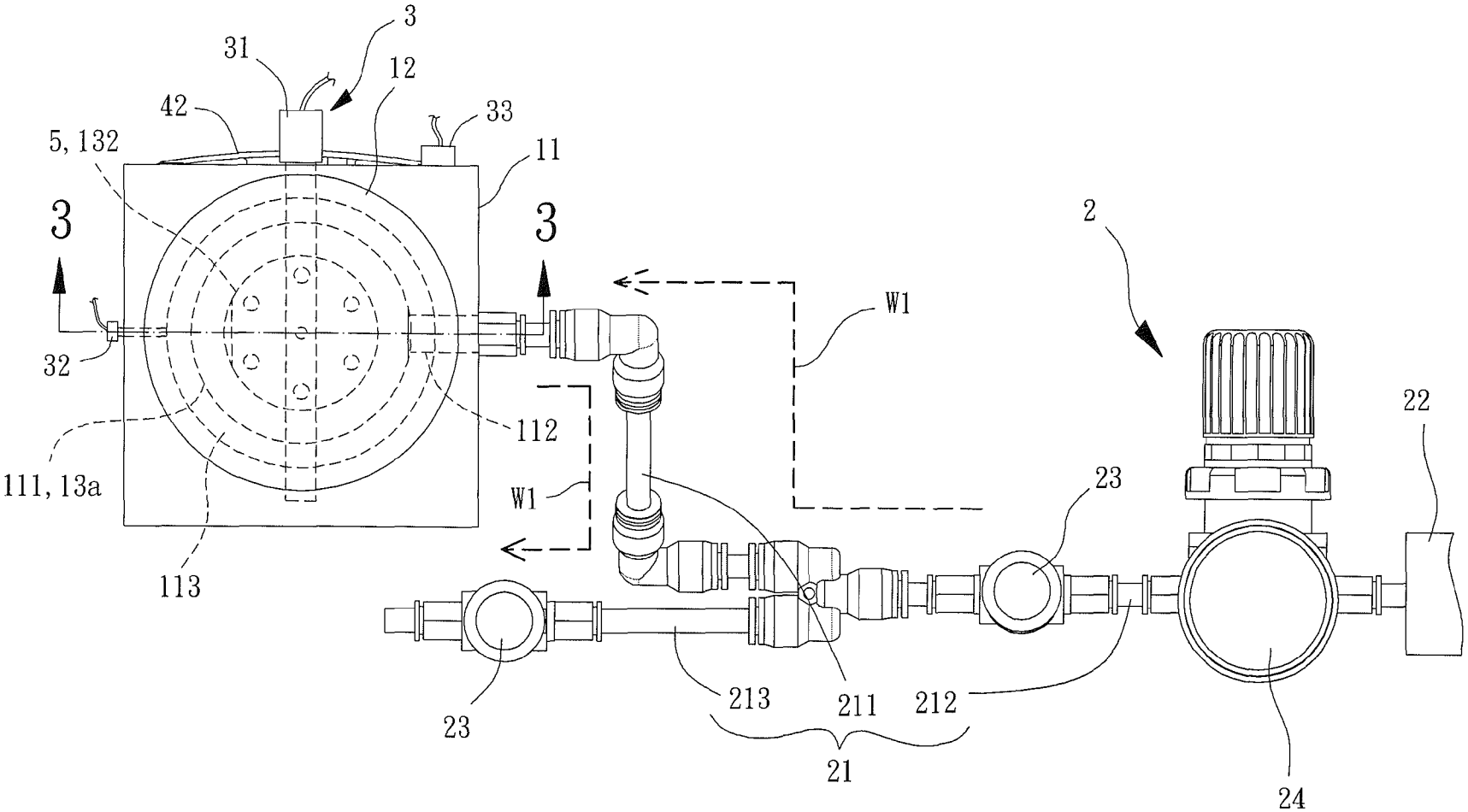
FIG. 2 is diagrammatic top view of the microfluidic mixing device of the embodiment according to the present invention.
Figure 3:
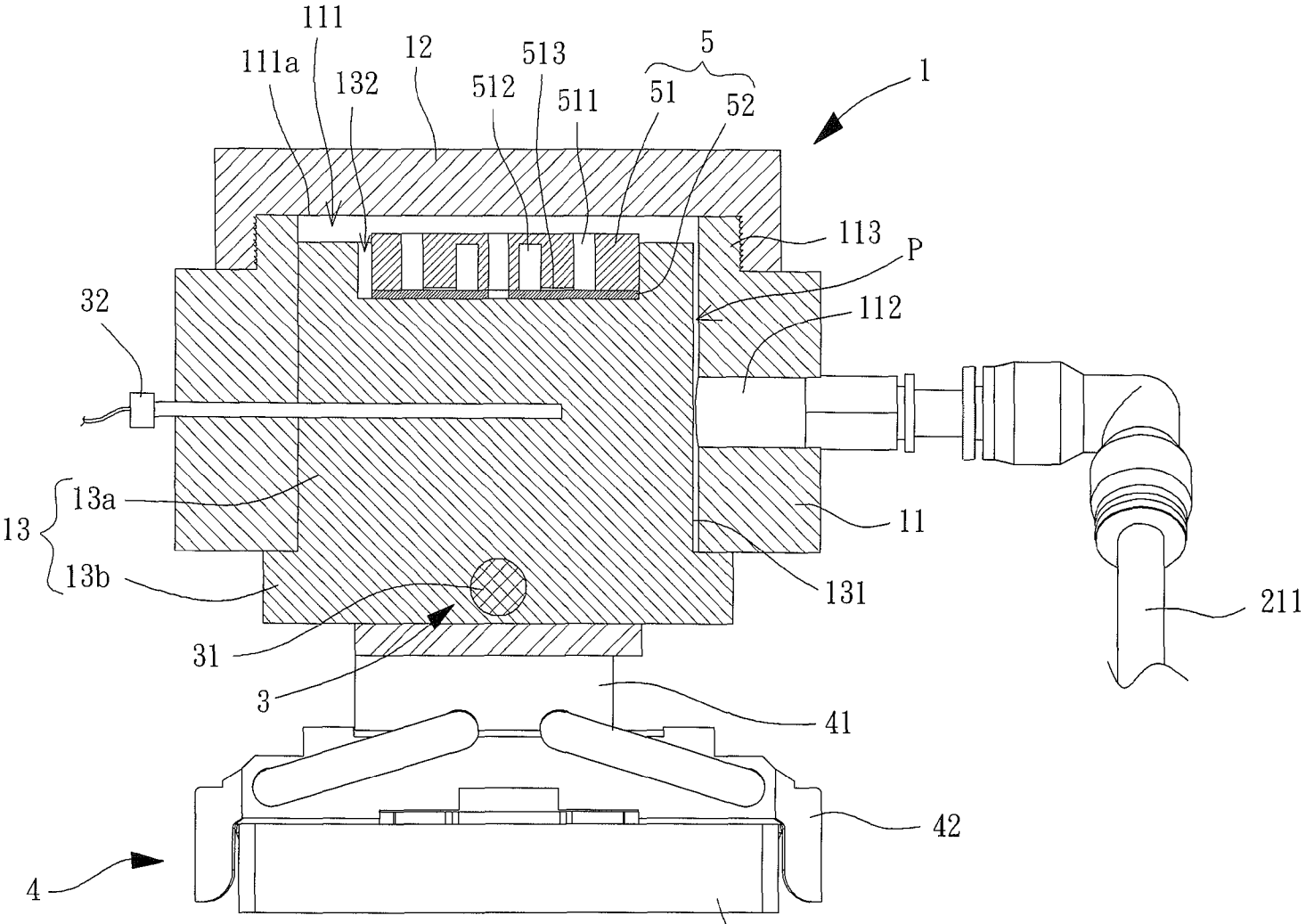
FIG. 3 is a cross sectional view taken along section line 3-3 of FIG. 2.

With reference to FIGS. 1-3, the body 1 includes a base 11, a sealing cover 12, and a thermally conductive member 13. The base 11 is hollow and includes a compartment 111. A chip access opening 111*a* is defined in an end of the compartment 111 to permit at least one microfluidic chip 5 to be placed into or retrieved from the compartment 111. An engagement opening 111 b is defined in the other end of the compartment 111. In this embodiment, the chip access opening 111*a* and the engagement opening 111*b* of the compartment 111 are respectively located on two axially opposite ends of the compartment 111. Preferably, the chip access opening 111*a* is located in the top end to permit a user to easily place or retrieve the microfluidic chip 5, providing operational convenience. The base 11 further includes a gas port 112 intercommunicated with the compartment 111, allowing a gas to flow into or out of the compartment 111.

The sealing cover 12 is detachably mounted to the base 11 to seal the chip access opening 111*a*. In this embodiment, the base 11 further includes a protrusion 113 in a location corresponding to the chip access opening 111*a*, and the sealing cover 12 is detachably mounted to the protrusion 113. As an example, the sealing cover 12 can be tightly coupled to the protrusion 113.

Alternatively, the protrusion 113 can include an outer thread on an outer periphery thereof, and the sealing cover 12 can include an inner thread on an inner periphery thereof for threading connection with the outer thread of the protrusion 113.

The thermally conductive member 13 is made of a material with a high thermal conductivity (such as copper or aluminum). The thermally conductive member 13 includes an insertion portion 13*a* and a sealing portion 13*b*. The insertion portion 13*a* substantially matches with the compartment 111 of the base 11 and, thus, can extend through the engagement opening 111*b* to be received in the compartment 111. The sealing portion 13*b* of the thermally conductive member 13 is coupled to an end of the insertion portion 13*a*. When the insertion portion 13*a* is received in the compartment 111, the sealing portion 13*b* abuts a bottom face of the base 11 to reliably seal the engagement opening 111*b* of the base 11. A gas passage P is defined between the insertion portion 13*a* of the thermally conductive member 13 and an inner periphery of the base 11 and is located in the compartment 111. The gas passage P intercommunicates with the gas port 112. In this embodiment, the insertion portion 13*a* of the thermally conductive member 13 is cylindrical and includes an outer periphery having a face 131 extending in an axial direction. The insertion portion 13*a* has a maximal outer diameter equal to or slightly smaller than a minimal diameter of the inner periphery of the base 11, such that the insertion portion 13*a* of the thermally conductive member 13 can be tightly mounted in the compartment 111. Alternatively, an adhesive can be applied to an outer periphery of the insertion portion 13*a* of the thermally conductive member 13 to tightly bond the insertion portion 13*a* of the thermally conductive member 13 with the inner periphery of the base 11 when the insertion portion 13*a* is received in the compartment 111. Furthermore, the face 131 is maintained in a position not abutting the inner periphery of the base 11 to form the gas passage P.

The thermally conductive member 13 further includes a chip compartment 132 having an opening for placing the microfluidic chip 5. Preferably, the opening of the chip compartment 132 faces the chip access opening 111*a* of the base 1. The user can open the sealing cover 12 to place the microfluidic chip 5 into the chip compartment 132 via the chip access opening 111*a*, and the microfluidic chip 5 is located in the compartment 111, increasing operational convenience. The chip compartment 132 provides a better positioning effect for the microfluidic chip 5. However, the thermally conductive member 13 does not have to include the chip compartment 132. In this case, the microfluidic chip 5 can be placed on a top face of the thermally conductive member 13.

The pressure control module 2 is connected to the gas port 112 of the base 11 to pressurize or relieve the pressure in the compartment 111. Specifically, the pressure control module 2 includes a piping unit 21, a gas pressure source 22, and a plurality of electromagnetic valves 23. The piping unit 21 forms a pressurizing passage W1 and a pressure relief passage W2. An end of the pressurizing passage W1 and an end of the pressure relief passage W2 intercommunicate with the gas port 112 of the base 11. The other end of the pressurizing passage W1 intercommunicates with the gas pressure source 22 (such as a high-pressure nitrogen tank). Thus, the gas pressure source 22 can fill gas into the pressurizing passage W1. An electromagnetic valve 23 is mounted on the pressurizing passage W1, and another second electromagnetic valve 23 is mounted on the pressure relief passage W2. In this embodiment, the piping unit 21 includes a first pipe 211, a second pipe 212, and a third pipe 213. An end of the first pipe 211, an end of the second pipe 212, and an end of the third pipe 213 intercommunicate with each other. The other end of the first pipe 211 is connected to the gas port 112 of the base 11. The other end of the second pipe 212 is connected to the gas pressure source 22. Thus, the gas pressure source 22 can fill the gas into the second pipe 212. The plurality of electromagnetic valves 23 can include two electromagnetic valves 23 respectively mounted on the second pipe 212 and the third pipe 213. Thus, the first pipe 211 and the second pipe 212 form the pressurizing passage W1. The first pipe 211 and the third pipe 213 form the pressure relief passage W2. The pressure control module 2 can further include a pressure adjusting valve 24. The pressure adjusting valve 24 is mounted to the gas pressure source 22 and is adapted to control an input amount of the gas from the gas pressure source 22. As an example, the pressure of the gas provided by the gas pressure source 22 can be adjusted to be 2 $Kg/cm^2$ to provide a better liquid pushing effect.

The heating module 3 is coupled to the thermally conductive member 13 of the body 1 to increase the gas temperature in the compartment 111. In this embodiment, the heating module 3 includes a heating member 31 extending through and coupled to the thermally conductive member 13. The heating member 31 is used to increase the temperature of the thermally conductive member 13 to thereby increase the gas temperature in the compartment 111. Preferably, the heating member 31 extends through and is coupled to the sealing portion 13*b* of the thermally conductive member 13. The heating module 3 further includes a temperature sensor 32 and a temperature controller 33. The temperature sensor 32 can be an elongated rod-shaped sensor. The temperature sensor 32 extends through the base 11 and is coupled to the insertion portion 13*a* of the thermally conductive member 13 for detecting the temperature of the thermally conductive member 13. The temperature controller 33 is electrically connected to the heating member 31 and the temperature sensor 32, receives a signal indicative of the temperature measured by the temperature sensor 32, and controls operation of the heating member 31 according to preset values.

The cooling module 4 is coupled to the thermally conductive member 13 of the body 1 to reduce the gas temperature in the compartment 111. In this embodiment, the cooling module 4 includes a cooling chip 41 and a cooler 42. A cold end of the cooling chip 41 abuts the sealing portion 13*b* of the thermally conductive member 13. The cooler 42 is coupled to a hot end of the cooling chip 41. The cooler 42 includes a plurality of fins for increasing the cooling efficiency at the hot end of the cooling chip 41. Preferably, the cooling module 4 further includes a cooling fan 43 coupled to the cooler 42 to rapidly carry away the heat generated by the cooler 42, further increasing the cooling efficiency at the hot end of the cooling chip 41 and, hence, effectively maintaining the cooling effect at the cold end of the cooling chip 41.

The microfluidic mixing device according to the present invention can be used with one or more microfluidic chips 5 as long as they can be received in the chip compartment 132 of the thermally conductive member 13. Furthermore, the microfluidic chip 5 is not limited to the form shown. In this embodiment, the microfluidic chip 5 includes a substantially circular chip body 51 and a cover 52. The chip body 51 includes a plurality of first mixing grooves 511 extending through the chip body 51 and a plurality of second mixing grooves 512 not extending through the chip body 51. The number of the first mixing grooves 511 is the same as that of the second mixing grooves 512. Furthermore, the first mixing grooves 511 and the second mixing grooves 512 are arranged in a circumferential direction about a center of the chip body 51 and correspond to each other. A micro channel 513 is defined between each pair of first and second mixing grooves 511 and 512. Preferably, the micro channel 513 is winding. The cover 52 abuts an end face of the chip body 51 to seal an end of each first mixing groove 511 and an open end of each second mixing groove 512.

Figure 4:
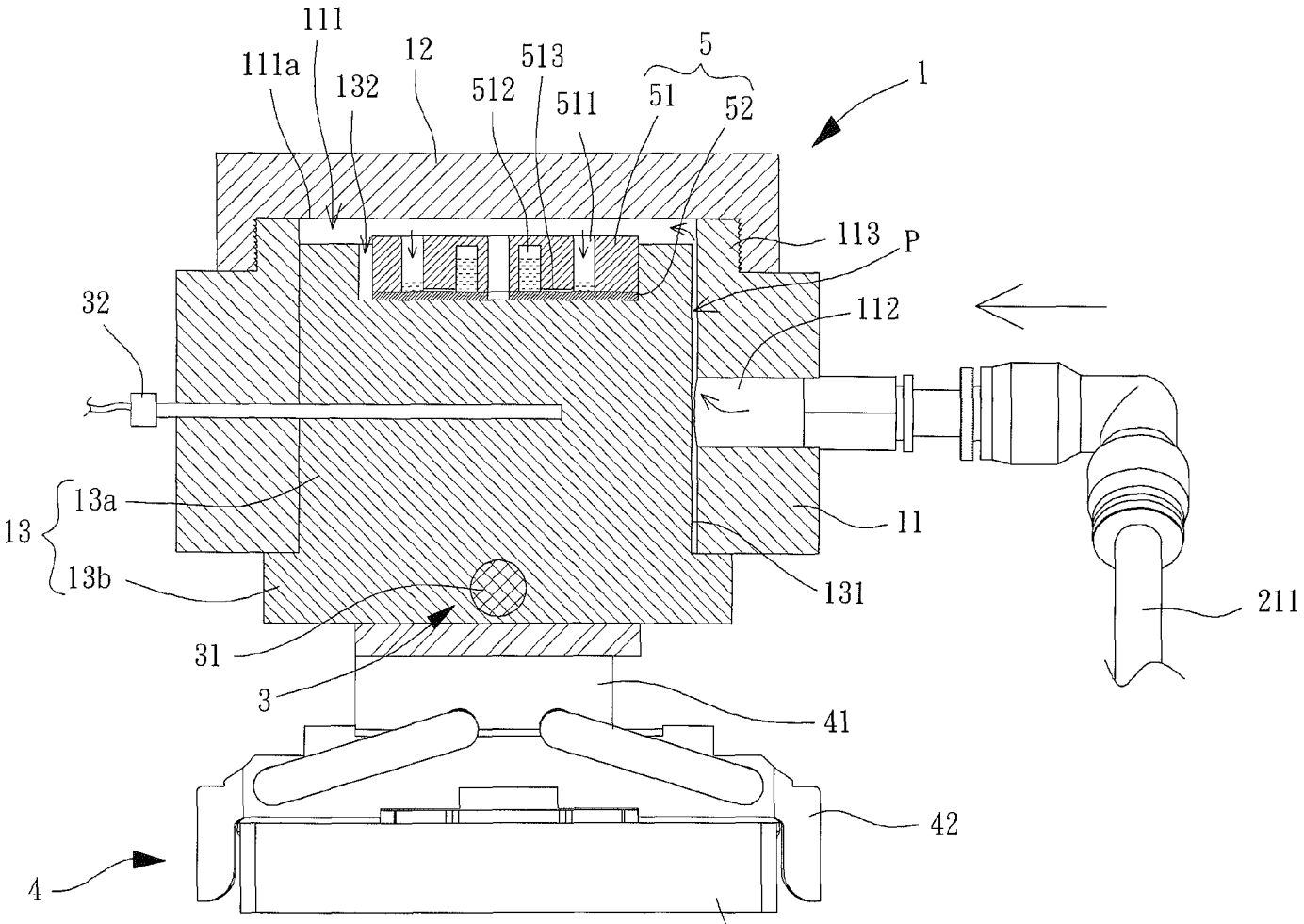
FIG. 4 is a cross sectional view similar to FIG. 3, illustrating a step of operation of the microfluidic mixing device of the embodiment according to the present invention.

With reference to FIGS. 1 and 4, in use of the microfluidic mixing device according to the present invention, the user places at least one microfluidic chip 5 into the chip compartment 132 of the thermally conductive member 13, and the liquids to be mixed are respectively filled into the first mixing grooves 511 without activating the gas pressure source 22. In this case, each sealed second mixing groove 512 has a gas pressure in balance with the gas pressure in the compartment 111, such that the liquid in each first mixing groove 511 is temporarily retained in the respective first mixing groove 511 rather than flowing into a corresponding second mixing groove 512. Then, the chip access opening 111*a* of the base 11 is sealed by the sealing cover 12, and the gas pressure source 22 is activated with the electromagnetic valve 23 on the second pipe 212 in an open state and with the electromagnetic valve 23 on the third pipe 213 in a closed state. The gas flow provided by the gas pressure source 22 passes through the second pipe 212 and the first pipe 211 (the pressurizing passage W1) and flows to the base 11. Then, the gas flow enters the compartment 111 via the gas port 112 of the base 11 and the gas passage P, gradually increasing the environmental pressure in the compartment 111 to be larger than the gas pressure in each second mixing groove 512. Thus, the liquids temporarily stored in the first mixing grooves 511 are affected by the gradually increasing environmental pressure, flow through the micro channels 513 into the respective second mixing grooves 512, and generate a vortex mixing phenomenon in the second mixing grooves 512 to proceed with uniform mixing (the mixture is hereinafter referred to as "liquid mixture").

Figure 5:
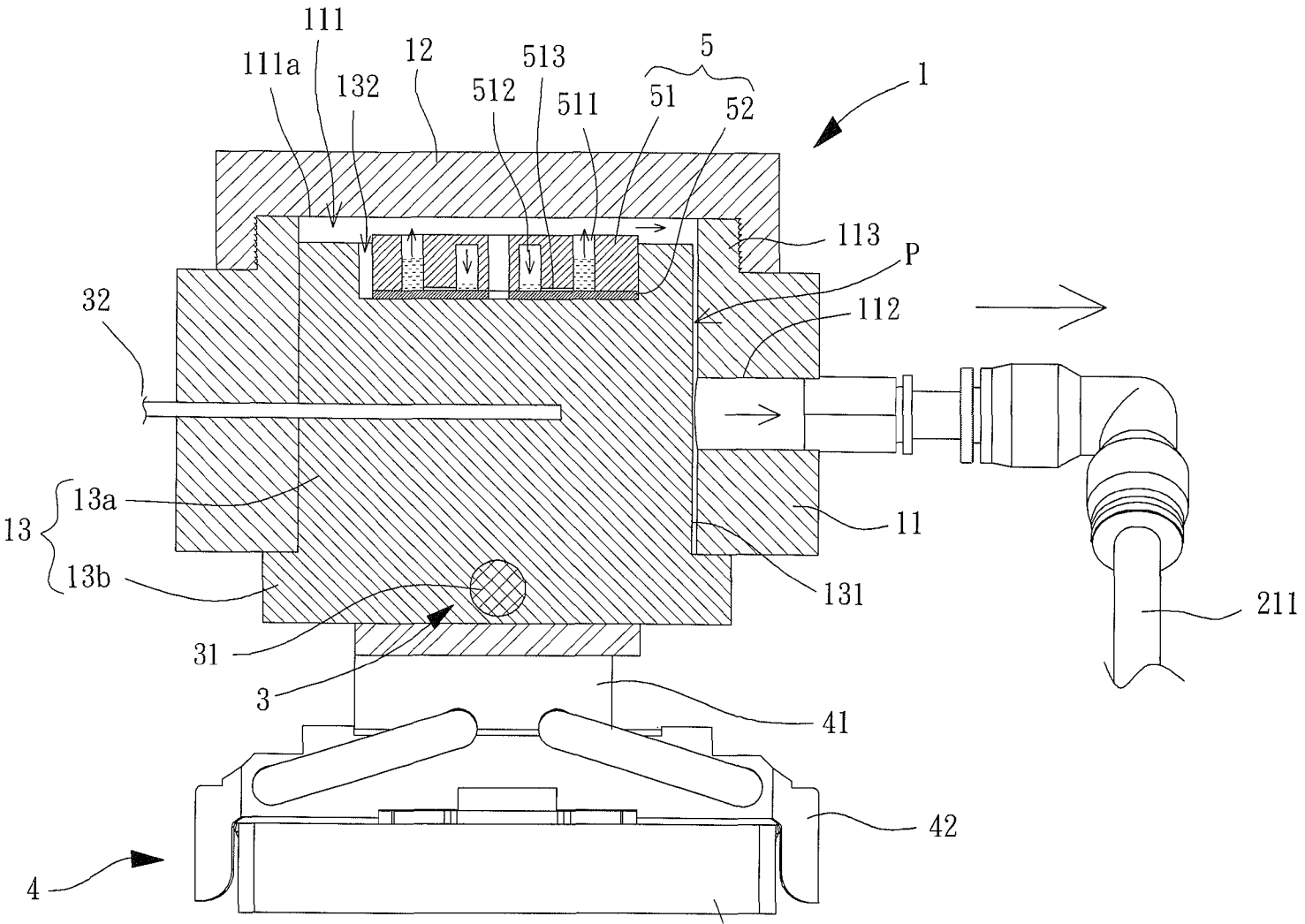
FIG. 5 is a cross sectional view similar to FIG. 3, illustrating another step of operation of the microfluidic mixing device of the embodiment according to the present invention.

With reference to FIGS. 1 and 5, when the liquids to be mixed are completely filled into the second mixing grooves 512, the gas pressure source 22 is turned off, the electromagnetic valve 23 on the second pipe 212 is switched to the closed state, and the electromagnetic valve 23 on the third pipe 213 is switched to the open state, such that the gas in the compartment 111 can be discharged after flowing through the first pipe 211 and the third pipe 213 (the pressure relief passage W2), gradually reducing the environmental pressure in the compartment 111. At this time, the original gas pressure in each sealed second mixing groove 512 pushes the liquid mixture in the respective second mixing groove 512 back into the corresponding first mixing groove 511 until the gas pressure in each second mixing groove 512 is in balance with the environmental pressure in the compartment 111. A liquid mixture of preliminary mixing is obtained after the pressure balance between the first mixing grooves 511 and the second mixing grooves 512 is reached. These steps can be repeated a plurality of times to increase the homogeneity of the liquid mixture.

As for some liquid mixtures whose chemical reaction efficiency can be increased by heating, the heating member 31 of the heating module 3 can be activated after mixing. The heating member 31 increases the temperature of the thermally conductive member 13 to increase the temperature of the microfluidic chip 5 and the temperature of the gas in the compartment 111 of the base 11. The heating member 31 of the heating module 3 stops heating the thermally conductive member 13 after the heating step. Then, the cooling chip 41 of the cooling module 4 can be activated to lower the temperature of the thermally conductive member 13 to the original operational temperature, stopping or slowing the chemical reaction of the liquid mixture to a chemically stable state.

In view of the foregoing, the microfluidic mixing device according to the present invention can be used with microfluidic chips 5 and can utilize a single pressure control module 2 to control simultaneously mixing of a plurality of sets of liquids, reducing the hardware cost and increasing the detection efficiency.

Furthermore, the microfluidic mixing device according to the present invention can accomplish all operations required for mixing the microfluids at a time,and the detection result will not be adversely affected by degradation of the liquid mixture that occurs while moving the microfluidic chips 5. The operational convenience and the precision of the detection result are increased.

Furthermore, the microfluidic mixing device according to the present invention can integrate and provide functions for detection of microfluids and, thus, provides portability. Thus, an operator can carry the microfluidic mixing device to any place for proceeding with a detection operation of the microfluids.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A microfluidic mixing device comprising:

a body including a base, a sealing cover, and a thermally conductive member, with the base being hollow and including a compartment, with a chip access opening defined in an end of the compartment, with an engagement opening defined in another end of the compartment, with the base further including a gas port intercommunicated with the compartment, with the sealing cover detachably mounted to the base to seal the chip access opening, with the thermally conductive member mounted to the base and sealing the engagement opening, with a gas passage defined between the thermally conductive member and an inner periphery of the base and located in the compartment, and with the gas passage intercommunicated with the gas port;

a pressure control module connected to the gas port of the base;

a heating module coupled to the thermally conductive member; and a cooling module coupled to the thermally conductive member, with the cooling module including a cooling chip and a cooler, with the cooling chip including a cold end abutting a sealing portion of the thermally conductive member, and with the cooling chip further including a hot end coupled to the cooler.

2. The microfluidic mixing device as claimed in claim 1, with the cooling module further including a cooling fan coupled to the cooler.

3. The microfluidic mixing device as claimed in claim 1, with the base further including a protrusion in a location corresponding to the chip access opening, and with the sealing cover detachably mounted to the protrusion.

4. The microfluidic mixing device as claimed in claim 1, wherein the heating module and the pressure control module have independent operations from each other.

5. The microfluidic mixing device as claimed in claim 1, with the thermally conductive member including a chip compartment, and with the chip compartment having an opening facing the chip access opening of the base.

6. The microfluidic mixing device as claimed in claim 5, with the chip access opening and the engagement opening of the compartment respectively located on two axially opposite ends of the compartment.

7. The microfluidic mixing device as claimed in claim 1, with the pressure control module including a piping unit, a gas pressure source, and first and second electromagnetic valves, with the piping unit forming a pressurizing passage and a pressure relief passage, with an end of the pressurizing passage and an end of the pressure relief passage intercommunicated with the gas port of the base, with another end of the pressurizing passage intercommunicated with the gas pressure source, with the first electromagnetic valve mounted on the pressurizing passage, and with the second electromagnetic valve mounted on the pressure relief passage.

8. The microfluidic mixing device as claimed in claim 7, with the piping unit including a first pipe, a second pipe, and a third pipe, with an end of the first pipe, an end of the second pipe, and an end of the third pipe intercommunicated with each other, with another end of the first pipe connected to the gas port of the base, with another end of the second pipe connected to the gas pressure source, with the first electromagnetic valve mounted on the second pipe, with the second electromagnetic valve mounted on the third pipe, with the first pipe and the second pipe forming the pressurizing passage, and with the first pipe and the third pipe forming the pressure relief passage.

9. The microfluidic mixing device as claimed in claim 7, with the pressure control module further including a pressure adjusting valve, with the pressure adjusting valve mounted to the gas pressure source, and with the pressure adjusting valve adapted to control an input amount of a gas from the gas pressure source.

10. The microfluidic mixing device as claimed in claim 1, with the thermally conductive member further including an insertion portion, with the sealing portion of the thermally conductive member coupled to an end of the insertion portion, with the insertion portion extending through the engagement opening of the base and received in the compartment, and with the sealing portion abutting a bottom face of the base to seal the engagement opening of the base.

11. The microfluidic mixing device as claimed in claim 10, with the insertion portion of the thermally conductive member including an outer periphery having a face extending in an axial direction, and with the face not abutting the inner periphery of the base to form the gas passage.

12. The microfluidic mixing device as claimed in claim 10, with the insertion portion having a maximal outer diameter equal to a minimal diameter of the inner periphery of the base, and with the insertion portion of the thermally conductive member tightly engaged with the inner periphery of the base.

13. The microfluidic mixing device as claimed in claim 10, with the insertion portion having a maximal outer diameter smaller than a minimal diameter of the inner periphery of the base, and with an adhesive applied to an outer periphery of the insertion portion of the thermally conductive member to tightly bond with the inner periphery of the base.

14. The microfluidic mixing device as claimed in claim 10, with the heating module including a heating member, and with the heating member extending through and coupled to the sealing portion of the thermally conductive member.

15. The microfluidic mixing device as claimed in claim 14, with the heating module further including a temperature sensor and a temperature controller, with the temperature sensor extending through the base and coupled to the thermally conductive member, and with the temperature controller electrically connected to the heating member and the temperature sensor.

16. The microfluidic mixing device as claimed in claim 15, with the temperature sensor extending through the base and coupled to the insertion portion of the thermally conductive member.

* * * * *